United States Patent [19]

Welch et al.

[11] 4,432,416

[45] Feb. 21, 1984

[54] WELL FLOW CONTROL APPARATUS

[75] Inventors: William R. Welch; Ernest P. Fisher; John H. Yonker, all of Carrollton, Tex.

[73] Assignee: Otis Engineering Corporation, Dallas, Tex.

[21] Appl. No.: 351,547

[22] Filed: Feb. 23, 1982

[51] Int. Cl.[3] ..... E21B 23/02; E21B 43/12

[52] U.S. Cl. ..... 166/117.5; 294/86.25; 166/125

[58] Field of Search ..... 166/117.5, 386, 322, 166/123-125, 181, 182, 317, 316; 294/86.18, 86.25, 94

[56] References Cited

U.S. PATENT DOCUMENTS

| | | | |
|---|---|---|---|
| 3,108,637 | 10/1963 | Lee et al. | 294/86.25 |
| 3,633,670 | 1/1972 | Brown et al. | 166/125 |
| 4,035,011 | 7/1977 | Gazda et al. | 166/125 X |
| 4,043,390 | 8/1977 | Glotin | 166/125 X |
| 4,051,889 | 10/1977 | Fredd | 294/86.25 X |
| 4,066,128 | 1/1978 | Davis et al. | 166/117.5 X |
| 4,294,313 | 10/1981 | Schwegman | 166/117.5 |

*Primary Examiner*—Ernest R. Purser
*Assistant Examiner*—Thuy M. Bui
*Attorney, Agent, or Firm*—H. Mathews Garland

[57] ABSTRACT

A side pocket mandrel designed primarily for controlling the flow of production fluid into a tubing string includes a sliding sleeve valve in the side wall receptacle for alternatively closing and opening the entry port into the receptacle. The sleeve valve is latched in its port-closing position, but is designed to enable removal from the receptacle bore for servicing; and a pulling tool is provided for removing the sleeve valve from the receptacle when desired. The sleeve is shifted to its port-opening position when a standing flow control valve is placed in the receptacle; and the standing valve has a large valve chamber and side entry and exit ports for the production fluid to provide for maximum flow. The standing valve provides a check valve into the producing zone, the valve closure member being a modified ball consisting of a cylindrical body with spherical ends and coacting with a spherical valve seat. During flow through the valve, the closure member is moved completely out of the flow path for maximum flow.

20 Claims, 14 Drawing Figures

WELL FLOW CONTROL APPARATUS

BACKGROUND OF THE INVENTION

This invention relates to apparatus for controlling the flow of production fluid into a well flow conductor or tubing string, from the annulus surrounding that tubing string, and more particularly to side pocket mandrels and flow control devices contained in the side pocket receptacle thereof for that purpose.

Side pocket mandrels have been used for many years for different applications involving the flow of fluid from the exterior of a tubing string into the interior thereof. Davis et al U.S. Pat. No. 4,066,128, issued Jan. 3, 1978, is concerned with a side pocket mandrel including a flow control device in the side pocket thereof for controlling the injection of gas into the tubing for a gas lift operation. The flow control device of this patent includes a sliding sleeve valve which controls the port opening into the side pocket receptacle from the exterior of the mandrel, and is shiftable between a port-closing and a port-opening position. This sliding sleeve valve is operated automatically by a flow control valve which is inserted selectively into the side pocket receptacle of the mandrel. When the control valve is placed therein, the sleeve valve is automatically moved to the port-opening position, and when the control valve is removed from the receptacle the sliding sleeve valve is moved to the port-closing position.

A valve for controlling the flow of production fluid into the tubing string must be a more rugged valve to withstand the abrasive characteristics of the production fluid, and desirably has the largest possible flow path to present minimal restriction to the flow of production fluid.

Prior art devices for this purpose include sliding sleeve valves, sometimes referred to as sliding side door valves, which are placed concentrically in the tubing string as components thereof and which function in a similar manner to the above mentioned sliding sleeve valve in that a sleeve is shiftable between a port-opening and port-closing condition. These valves are operated in a similar manner by the placing or removal of a flow control valve referred to as a standing valve, the sleeve valve being automatically shifted to the open condition when the standing valve is placed, and being shifted to the closing position when the standing valve is removed. A disadvantage of this arrangement is that if it is desired to perform any service work below the zone being produced, at least one trip must be made to remove the standing valve and shift the associated sleeve valve closed, thus shutting off production flow before the servicing work can be performed. The production flow of the well must remain shut off during any service work to be performed below that zone which is being produced. For a pumpdown installation, it may well be that production flow will have to be shut off for service work above that producing zone also, lest circulation be lost to the open zone.

Another prior art device for this purpose consists of a side pocket mandrel designed to receive a flow control valve in the side pocket receptacle. This type device has the advantage that the standing flow control valve is offset from the main flow path of the tubing string, and permits the passing of other well tools through the string past the standing valve for such service operations as may be required. A disadvantage of this device is that when the standing valve is removed, there is an open path between the exterior and interior of the tubing; and to close this path it is necessary to place in the side pocket receptacle a dummy choke valve. Two separate operations, then, are necessary to switch between an open flow condition and a no-flow condition. When using wireline servicing, two trips are usually required.

While the tools discussed above may be used for both wireline servicing and pumpdown servicing, it is more important in pumpdown servicing that tools may be designed to minimize the number of trips into the well since these trips are over a much longer distance than similar trips in wireline servicing. The demand for pumpdown servicing is increasing, and there are situations, such as a plurality of satellite wells serviced from a central platform, where pumpdown servicing is the only practical servicing method.

It is desirable then to provide a flow control device having the capability to control the flow of production fluid into the tubing string and including a combination sliding sleeve valve operated by a standing flow control valve to simplify the operations of placing and removing the standing flow control valve.

OBJECTS AND SUMMARY OF THE INVENTION

An object of this invention is to provide an improved flow control device in a side pocket mandrel for flowing fluid into a tubing string from the surrounding annulus.

Another object of this invention is to provide an improved flow control device in a side pocket mandrel having adequate capacity and wear characteristics for flowing production fluid into a tubing string from the surrounding annulus. A related object is to provide such device including a sliding sleeve valve operated automatically by a selectively placed standing valve.

A further object of this invention is to provide an improved flow control device in a side pocket mandrel including a sliding sleeve valve operated automatically by a standing valve, where the sliding sleeve valve can be removed from the side pocket mandrel for servicing. A related object is to provide such sliding sleeve valve and an associated pulling tool for removing the sliding sleeve valve from the side pocket mandrel.

Still another object of this invention is to provide an improved standing valve for use with a sliding sleeve valve in a side pocket mandrel, for controlling the flow of production fluid into a tubing string from the surrounding annulus.

A still further object of this invention is to provide a pulling tool for removing a sliding sleeve valve from a side pocket mandrel, where the pulling tool has means to release its latching mechanism in the event that the sliding sleeve valve cannot be withdrawn.

These objects are accomplished in a well device for controlling flow between the exterior and interior of a well flow conductor. The well device includes a side pocket mandrel having a longitudinal main bore and having a longitudinal receptacle bore in a side pocket opening to the main bore, the mandrel being connectible in the well flow conductor with its main bore in axial alignment therewith. The receptacle bore has lateral port means through its wall to the exterior of the mandrel, and has annular seal surfaces at opposite sides of that lateral port means engageable with a flow control device. A first flow control device comprises a sleeve valve disposed for reciprocation in the receptacle bore between port-closing and port-opening positions for controlling flow through the port, and the sleeve valve has seal means coacting with the seal surface means of the receptacle bore. The receptacle bore and the sleeve valve have coacting latching means for retaining the sleeve valve in the port-closing position. The sleeve valve is movable to the port-opening position and returned to the port-closing position in response to the insertion and removal of a second flow control device in the receptacle bore. In this improved well device, the sleeve valve has latching means for coaction with the latching means of a pulling tool to enable withdrawal of the sleeve valve from the receptacle bore. These objects are also achieved in such a well device including a control valve having an elongated body configured to be received within the receptacle bore. The valve body has an internal longitudinal valve chamber, including a larger bore portion at one end and a smaller bore portion at the other end providing an annular shoulder defining a valve seat. A valve closure member is slidable in the larger bore portion for coaction with the valve seat. The valve chamber further has a first lateral port in its wall opening from the smaller diameter portion, and a second lateral port through its wall opening from the larger diameter portion. The first valve port is disposed for lateral alignment with the receptacle bore lateral port when the control valve is latched in the receptacle bore. The receptacle bore has a second lateral port in its wall opening into the mandrel main bore, and the second valve port is aligned with that second receptacle bore port when the valve is latched in the receptacle bore.

These objects are also accomplished in a pulling tool for coaction with an internal annular latching recess in the sliding sleeve valve. The pulling tool has latching means coacting with that annular latching recess to withdraw the sliding sleeve valve, and has means for releasing its latching means in the event that the sleeve valve cannot be withdrawn, to enable recovery of the pulling tool and other well tools and devices connected to it.

The novel features and the advantages of the invention, as well as additional objects thereof, will be understood more fully from the following description when read in connection with the accompanying drawings.

DRAWINGS

FIG. 1 is a diagrammatic illustration of a portion of an oil well having dual tubing strings and multiple production zones;

FIGS. 2A and 2B taken together constitute a longitudinal sectional view of a side pocket mandrel and flow control devices according to the invention;

Figure 7:
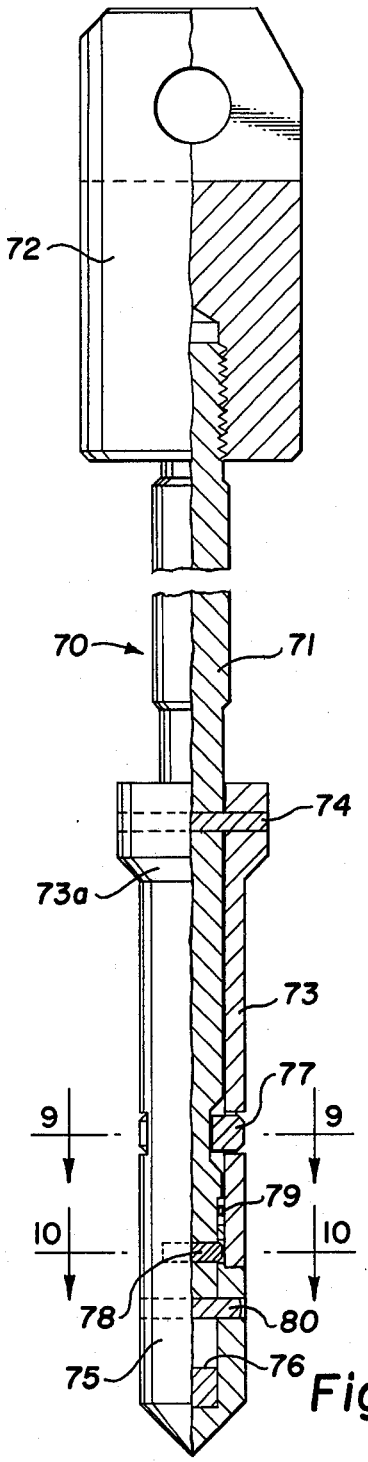
FIG. 7 is a view, partially in elevation and partially in section, of a pulling tool for withdrawing the flow control sliding sleeve valve.
Figure 8:
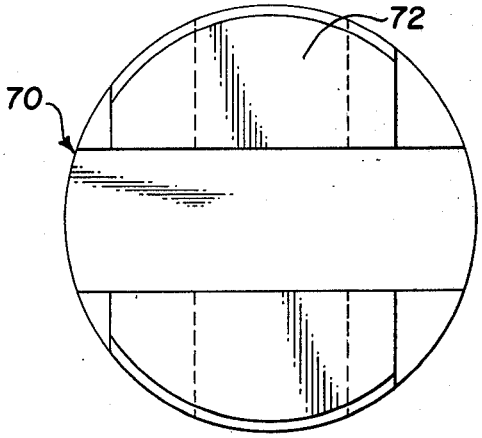
FIG. 8 is a view of the clevis end of the tool of FIG. 7.
Figure 9:
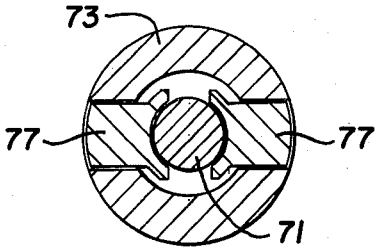
Figure 10:
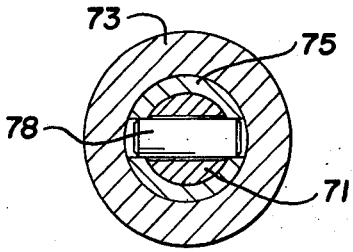
Figure 11:
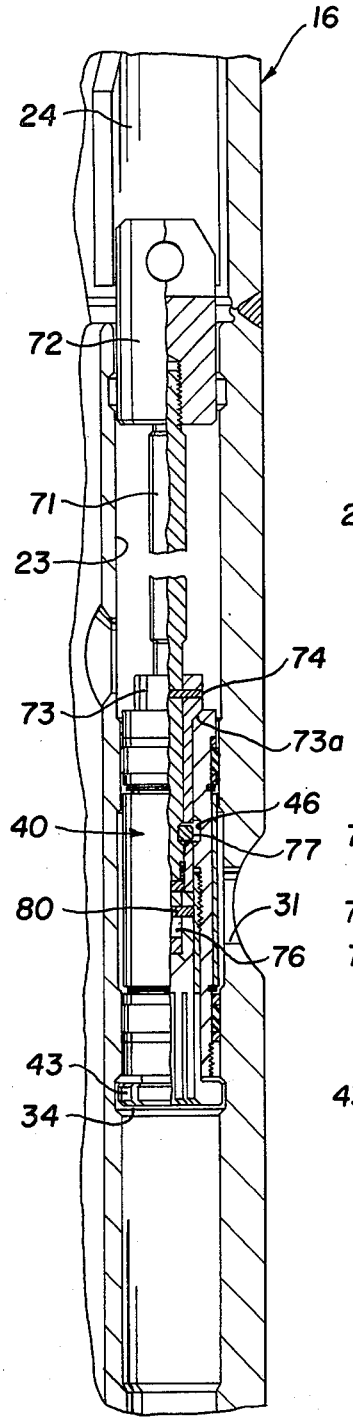
Figure 12:
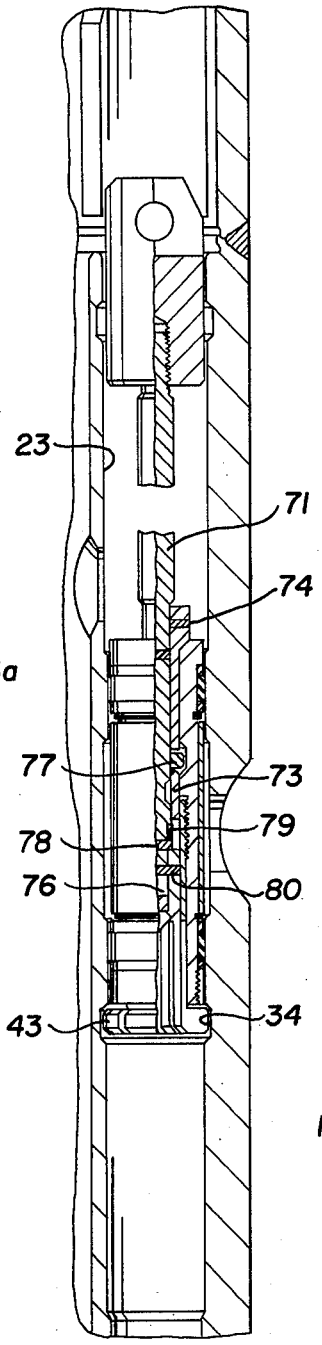
Figure 13:
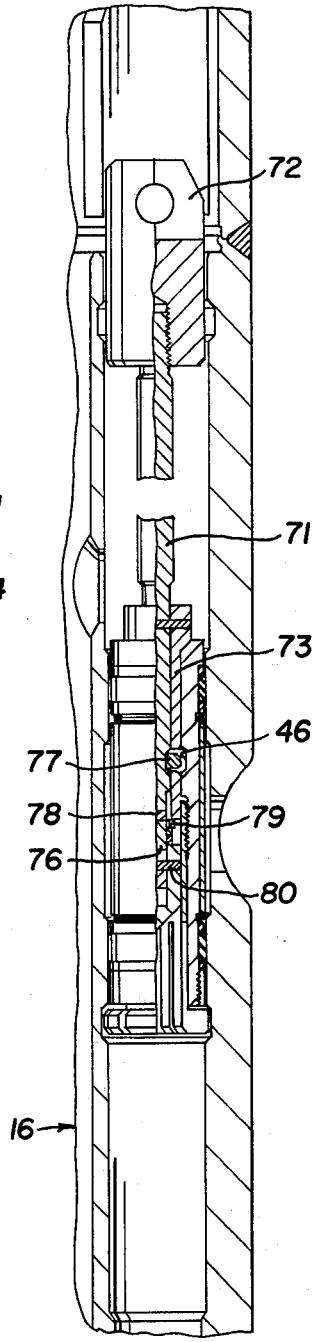

FIGS. 9 and 10 are transverse sectional views taken along the line 9—9 and 10—10 of FIG. 7; and FIGS. 11, 12 and 13 are fragmentary sectional views of the side pocket mandrel and sliding sleeve valve and including different operative positions of the pulling tool of FIG. 7.

DESCRIPTION OF THE PREFERRED EMBODIMENT

Figure 1:
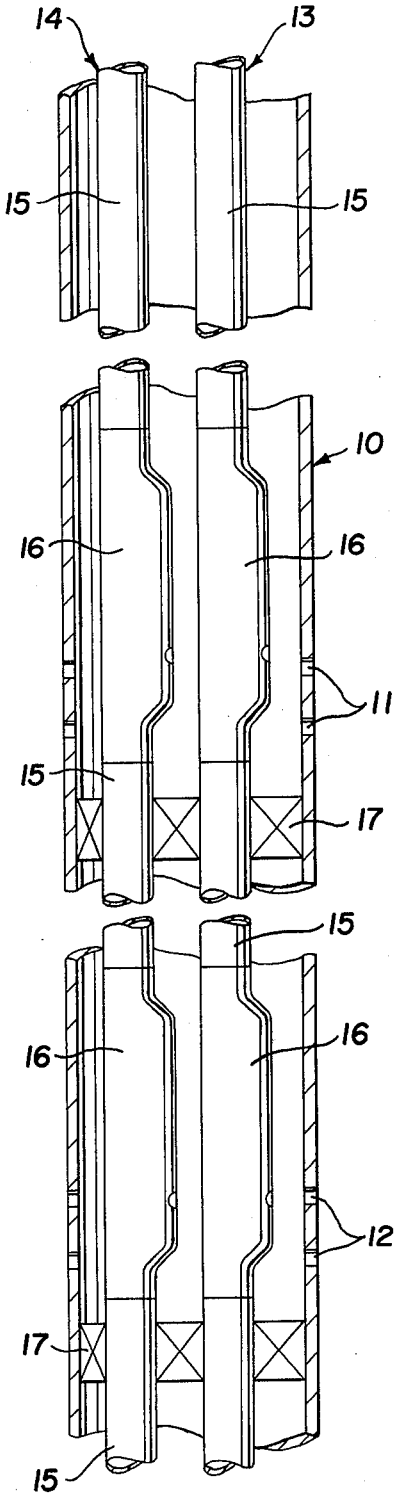
Figure 3:
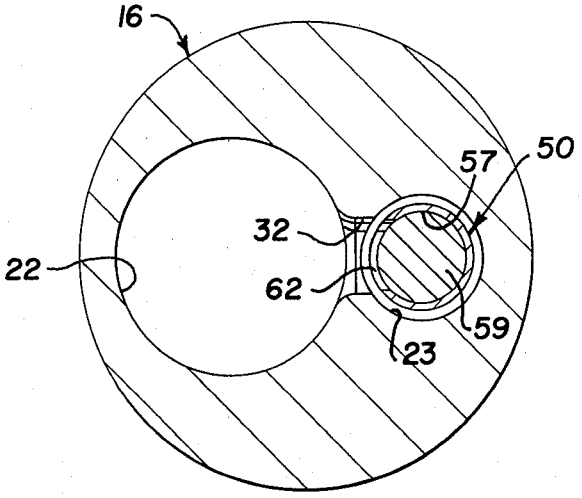
FIG. 3 is a transverse sectional view taken along the line 3—3 of FIG. 2A.
Figure 4:
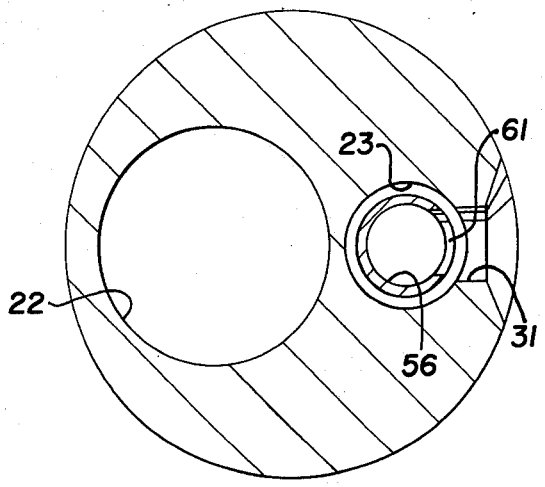
FIG. 4 is a transverse sectional view taken along the line 4—4 of FIG. 2B.

FIG. 1 is a diagrammatic illustration of a portion of a producing oil well having two production zones. The well includes a casing 10 having perforations 11 identifying an upper production zone and perforations 12 identifying a lower production zone. The well includes a dual tubing string identified as a primary string 13 and a secondary string 14. As illustrated, either of the tubing strings may function as a primary string to carry production fluid to the surface. Both strings could be used simultaneously for producing two different zones. In the drawing, the only components of the strings identified are sections of tubing 15 and side pocket mandrels 16. Packers 17 seal the casing with respect to the tubing strings and isolate the several production zones.

The dual tubing strings represent a typical installation for pumpdown completion and servicing. At a low point in the well, and possibly at some intermediate points, an H-member is installed to provide communication between the two strings, and a circulation valve associated with the H-member is selectively closed and opened to provide or inhibit that communication. For the running in and removal of well tools from the primary string 13, the communication valve is opened so that the secondary string 14 will provide for return circulation of fluid during run in of tools, and for the pump-down of fluid to effect the return of tools from the primary string.

Figure 2A:
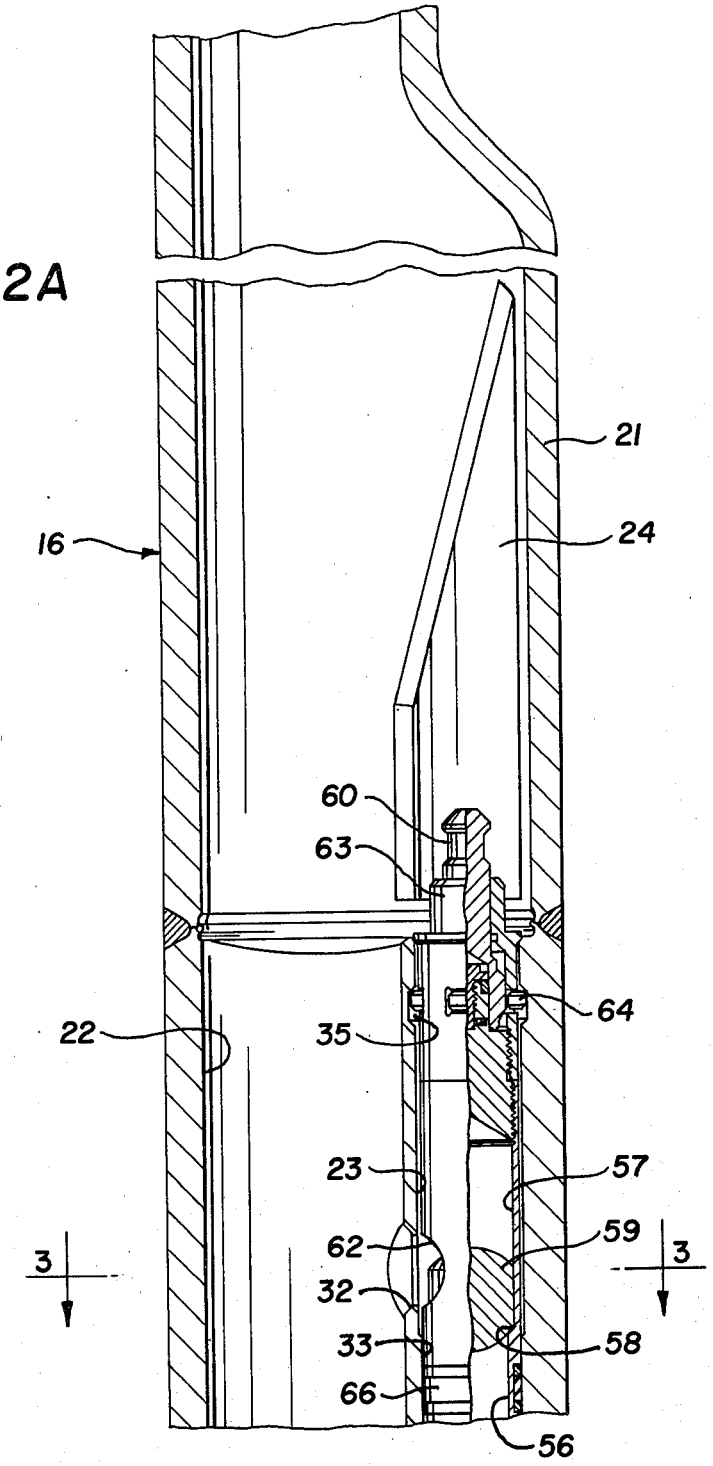
Figure 2B:
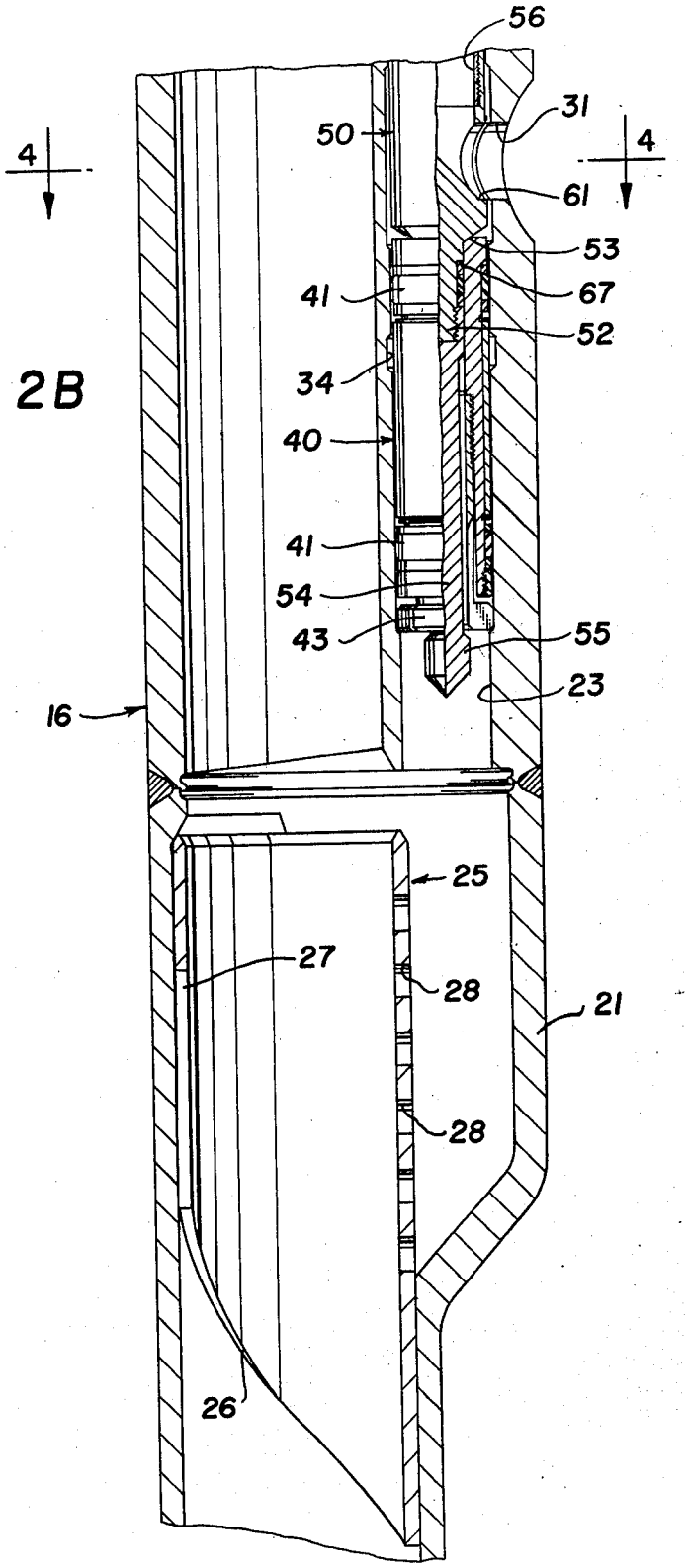

FIGS. 2A and 2B together illustrate a side pocket mandrel 16 which consists of an elongated tubular body having an eccentric side pocket or belly 21 intermediate its ends. The body has couplings at either end for joining to sections of tubing, and provides a straight through main bore 22 for alignment with the tubing and to enable the passing of well tools through the tubing string. A generally parallel smaller receptacle bore 23 is provided at the side pocket, communicating at both ends with the main bore. The side pocket has substantial length above the receptacle bore to provide room for laterally shifting a flow control device for alignment with the receptacle bore, and guide shoes 24 mounted just above the receptacle bore assist in guiding flow control devices into the receptacle bore.

A mule shoe cam 25 is mounted concentrically with the main bore 22 below the receptacle bore 23, includes a lower guide or cam surface 26 and a guide slot 27. These are provided for coaction with a key or dog on a kickover tool to rotationally orient the kickover tool relative to the side pocket of the mandrel. In the installation, the kickover tool is run in to a point that the key is below the mule shoe cam, and then reversed and moved back wherein the key is guided into the guide slot 27. When the key reaches the upper limit of the slot the kickover tool is properly oriented to enable the swinging of a pivot arm into the side pocket and in alignment with the receptacle bore 23 for installation or removal of a tool in the receptacle bore. In the drawing, the mule shoe cam is provided with ports 28 for communicating the lower end of the receptacle bore with the main bore.

Figure 5:
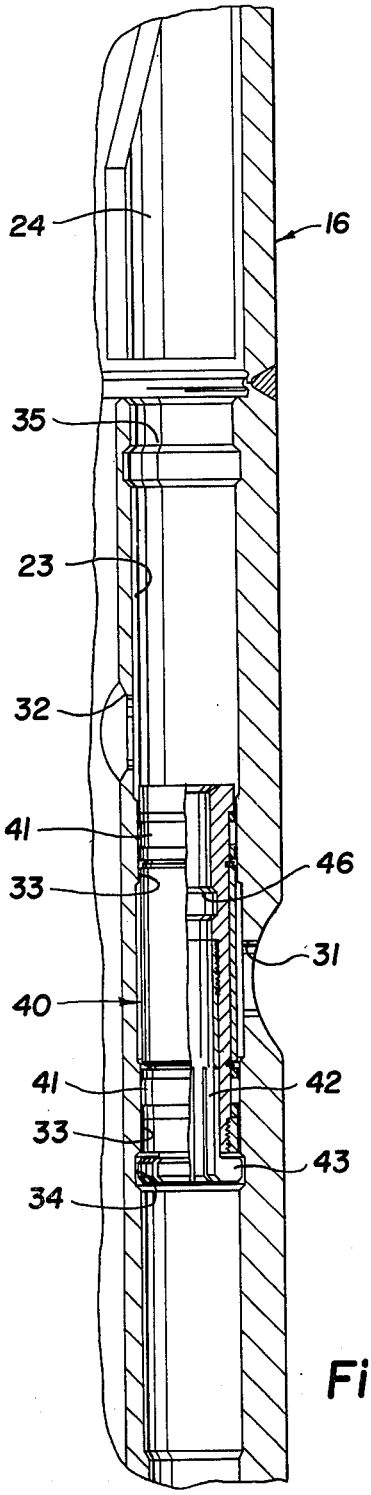
FIGS. 5 and 6 are fragmentary sectional views of the well flow devices in the side pocket mandrel, showing different relative positions of the flow control devices.
Figure 6:
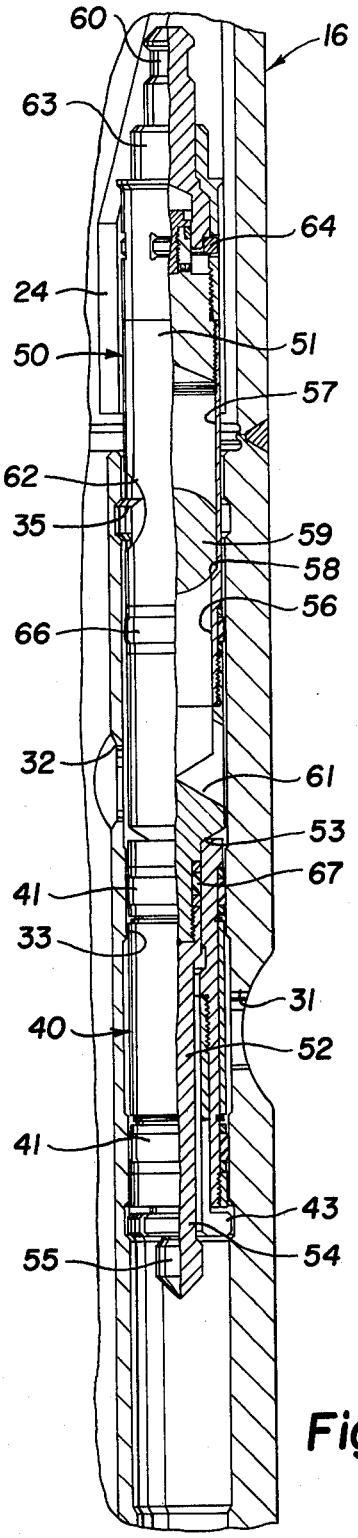

Turning now to the details of the receptacle bore and of the flow control devices which are placed therein, FIGS. 5 and 6 together with FIGS. 2A and 2B show different positions of the sleeve valve and the standing valve within the receptacle bore. The receptacle bore is provided with a lateral port 31 in its exterior wall, opening to the exterior of the side pocket mandrel for flow of fluid into the mandrel from the surrounding annulus. The receptacle bore is provided with a second lateral port 32 in its inner wall, opening to the main bore 22, this port being vertically above and opposite the port 31. The receptacle bore is further provided with cylindrical sealing surfaces 33 adjacent to the port 31, both above and below, to enable the sealing of the bore relative to the port 31. The receptacle bore is further provided with a latching recess 34 below the lower sealing surface 33, and a latching recess 35 adjacent to its upper end.

In FIG. 5 a sliding sleeve valve 40 is shown alone within the receptacle bore, latched in port-closing position wherein it bridges and seals the port 31. The sliding sleeve valve includes an elongated tubular body having external annular seals 41 adjacent to its upper and lower ends for coaction with the above mentioned sealing surfaces 33. The valve includes an internal sleeve carrying elongated circumferentially spaced collet fingers 42 which extend beyond the lower end of the valve body, and these fingers carry radially outward extending dogs 43 which in the outermost position project beyond the exterior surface of the sleeve valve body and extend into the latching recess 34. The collet fingers, then, latch the sleeve valve in the port-closing position as seen in FIGS. 5 and 6. The sleeve valve is also provided with an internal latching recess 46 for a purpose to be described subsequently. The latching recess 34 and coacting collet dogs 43 are configured that with sufficient axial force applied to the sleeve valve, the dogs will be cammed inward to unlatch the sleeve valve and permit movement within the receptacle bore.

FIG. 6 illustrates the locating of a standing valve 50 with the receptacle bore and the lowering of this valve to the point where it just engages the sleeve valve 40. The standing valve includes an elongated body, the upper portion 51 of which is dimensioned for a relatively close fit within the receptacle bore, and having a reduced diameter prong 52 at the lower end to be received within the sleeve valve 40. The prong and upper body define a downward facing shoulder 53 for engagement with the upper end of the sleeve valve. When so engaged with the sleeve valve, the distal end of the prong extends below the lower end of the valve, and the prong is provided with a reduced diameter neck 54 adjacent to its distal end to allow inward deflection of the valve collet fingers 42, with the distal end of the prong then providing a larger head 55.

An elongated valve chamber is formed within the upper valve body above the shoulder 53 and includes a lower smaller diameter portion 56 and an upper larger diameter portion 57, providing an upward facing annular shoulder defining a valve seat 58. A valve closure member 59 is in the form of a modified spherical ball, being a cylindrical member with spherical ends. The closure member is dimensioned for a free sliding fit within the upper valve chamber 57, and the valve seat 58 is machined for coaction with the spherical end face of the closure member. A lower lateral port 61 is provided in the wall of the lower chamber 56; and an upper lateral port 62 is provided in the wall of the upper chamber 57, the upper port being diametrically opposite the lower port. The upper end of the standing valve body is attached to a lock mandrel 63 having a fishing neck 60 at its upper end for engagement with the running tool. The lock mandrel is provided with lateral windows carrying floating lugs 64; and the fishing neck 60 is shiftable within the lock mandrel to cam the lugs radially outward in one direction, and in the other direction to permit inward movement of the lugs 64.

FIGS. 2A and 2B illustrate the condition where the standing valve 50 is set and locked. The standing valve has been moved downward relative to the FIG. 6 position by the running tool causing the collet lugs 43 of the sleeve valve to be displaced inwardly to release from the latching recess 34; and the sleeve valve is now confined for axial movement with the standing valve between the shoulder 53 and the head 55. When the valves reach the position shown in FIGS. 2A and 2B the downward force acting on the fishing neck 60 cams the lugs 64 into the latching recess 35. The standing valve 50 is now locked in operative position within the receptacle bore and the sleeve valve is in its port-opening position.

The standing valve upper body includes an external annular seal 66 which is now in sealing relation with the upper seal surface 33 of the receptacle bore. The upper seal 41 of the sleeve valve is now in sealing relation with the lower seal surface 33 of the receptacle bore. The standing valve is provided with a lower annular seal 67 adjacent to the upper end of the prong 52 which coacts with an annular internal seal surface at the upper end of the sleeve valve body. The lower standing valve port 61 is now aligned laterally with the receptacle port 31, and the upper standing valve port 62 is aligned laterally with the receptacle port 32. For this rotational alignment of the ports to occur, it is necessary that the standing valve be correctly oriented relative to the kickover tool which runs the standing valve into the well. When the kickover tool is then oriented relative to the side pocket as above described, the standing valve will be properly oriented relative to the receptacle bore. A kickover tool for this application is described in Schwegman U.S. Pat. No. 4,294,313 issued Oct. 13, 1981.

The standing valve 50 functions as a check valve to allow flow of production fluid into the tubing string, but to prevent any back flow to the exterior of the string. This valve allows pumpdown work to be performed below the producing zone, and yet allow production fluid from that zone to flow to the surface. The valve seat and closure design provides for a good positive seal for the check valve, and provides a maximum flow path through the standing valve in relation to the size of the receptacle bore. During production flow, the valve closure member moves up completely out of the flow path between the ports 31 and 32, to minimize wear of the closure member from abrasive production fluid.

For removing the standing valve 50 from the receptacle bore, the fishing tool is engaged with the fishing neck 60 of the lock mandrel 63, and upward movement of the fishing neck relative to the valve body releases the lugs 64 from the latching recess and allows upward movement of the coupled standing and sleeve valves. When the valves reach the FIG. 6 location, the collet fingers will spring outward to latch the sleeve valve in the coupling recess 34; and the head 55 of the standing valve prong is then freed to allow continued movement of the standing valve to be withdrawn from the receptacle bore. The sleeve valve of course remains latched in the valve-closing position of FIG. 5.

It may be desirable to remove the sleeve valve 40 from a receptacle bore for servicing, for example such as for the replacement of the seals 41 should they become worn, or should the valve leak for some other reason. A pulling tool 70 for removing the sleeve valve is illustrated in FIGS. 7 through 10. This tool includes an elongated shaft 71 having an enlarged clevis 72 fixed to its upper end. A tubular dog housing 73 is secured to the shaft by means of a shear pin 74. A retaining nose piece 75 is secured to the shaft for limited relative longitudinal movement, by means of a pin 80 passing through an elongated slot 76 adjacent to the lower end of the shaft. The dog housing includes opposite windows for carrying latching lugs 77 which,. in the pinned position illustrated in FIG. 7, are received in an annular recess in the shaft 71 so as not to project from the periphery of the housing. The nose piece 75 includes an upper reduced diameter portion which is received within the lower end of the dog housing, and is further pinned to the shaft 71 by a short shear pin 78 extending into holes in the upper reduced diameter portion. An expanding snap ring 79 is confined in an annular recess defined by the upper end of the nose piece 75, a confronting shoulder of the shaft 71, and the dog housing 73. The dog housing has an enlarged head at its upper end providing a shoulder 73*a*.

The operation of the pulling tool is illustrated in FIGS. 11, 12 and 13. Referring to FIG. 11, the pulling tool 70 has been lowered into the receptacle bore and located within the sleeve valve 40 by the shoulder 73*a* which engages the upper end of the sleeve valve. As so located, the latching lugs 77 are laterally aligned with the latching recess 46 of the sleeve valve. With further downward movement of the pulling tool shaft 71, as seen in FIG. 12, the shear pin 74 is sheared and the shaft effects outward camming of the lugs into the latching recess. This movement carries the snap ring 79 below the lower end face of the dog housing 73; and the snap ring then expands under that lower end face to again couple the shaft 71 to the dog housing. This locks the dog housing axially relative to the sleeve valve. With subsequent lifting of the pulling tool shaft, the dog housing is carried with it, and the sleeve valve which is now locked to the dog housing is also carried with it. The lifting force disengages the sleeve valve latching lugs 43 from the associated latching recess 34, and the valve is then withdrawn from the receptacle bore and from the well.

If for some reason the sleeve valve becomes bound within the receptacle bore and cannot be removed, means must be provided to enable removal of the pulling tool and other tools associated with it from the well. FIG. 13 illustrates how this is accomplished. Upward movement of the shaft 71 is resisted by the dog housing which is locked to the sleeve valve. This results in a shearing of the shear pin 78 freeing the shaft for limited movement relative to the nose piece 75 and allowing the shaft to move upward to the point where the nose pin 80 moves to the bottom of the slot 76. When this occurs, the annular recess of the shaft is again aligned laterally with the lugs 77 allowing the lugs to move inward out of the sleeve valve latching recess 46, and therefore allowing withdrawal of the pulling tool from the sleeve valve.

When a sleeve valve 40 is to be run into the well and into a receptacle bore 23, this may be accomplished by latching the sleeve valve to a standing valve 50 at the surface, and running the coupled valves together into the receptacle bore. Alternatively, a running tool may be used, having the same coacting latching configuration as the standing valve.

What has been described is an improved flow control apparatus particularly adapted for controlling the flow of production fluid into a tubing string from the area surrounding that string. The flow control apparatus includes the combination of a sliding sleeve valve and a standing valve within the side pocket receptacle of a side pocket mandrel.

Since production fluid, particularly crude oil, frequently includes abrasive materials, certain features of the apparatus will adapt it to its primary purpose. One such feature is that the sliding sleeve valve is designed to be removed by wireline or pumpdown servicing methods from the side pocket receptacle for replacing seals for example; and another feature of the apparatus is that the ball closure member of the standing valve is designed to move out of the flow path of the fluid during production flow to minimize wear of that member. This also enables maximum flow or production fluid through the standing valve. Further the standing valve is designed to provide the largest possible flow path through the valve, within the limitations of the diameter of the side pocket receptacle.

A general feature and advantage of the invention then is the provision of a practical design for a sliding sleeve valve and a coacting standing valve particularly adapted for controlling the flow of production fluid.

An overall feature of the invention is the provision of a pulling tool for use with the sliding sleeve valve, to enable removal of the sliding sleeve valve from the receptacle bore. A related feature is the mechanism of the pulling tool which enables the pulling tool to be withdrawn from the receptacle bore after it has been latched to the sliding sleeve valve, in the event that the sliding sleeve valve becomes bound in the bore and cannot be removed.

An overall feature and advantage of the invention is that it provides a check valve in the tubing string into the producing zone in a manner that will permit pumpdown work within the well below that producing zone and yet allow the flow of production fluid to the surface. For example, it may be possible to perform service work on a flow control apparatus located at a production zone below the zone then producing.

While the preferred embodiment of the invention has been illustrated and described, it will be understood by those skilled in the art that changes and modifications may be resorted to without departing from the spirit and the scope of the invention.

What is claimed is:

1. In a well device for controlling flow between the exterior and interior of a well flow conductor which includes: a side pocket mandrel having a longitudinal main bore and having a longitudinal receptacle bore in said side pocket opening to said main bore, said mandrel being connectible in said well flow conductor with its main bore in axial alignment therewith; said receptacle bore having lateral port means through the wall thereof to the exterior of said mandrel, and annular seal surface means at opposite sides of said lateral port means engageable with a flow control device; a first flow control device comprising a sleeve valve disposed for reciprocation in said receptacle bore between port-closing and port-opening positions for controlling flow through said lateral port means, said sleeve valve having seal means coacting with said annular seal surface means of said receptacle bore; said receptacle bore and said sleeve valve having coacting latching means for retaining said sleeve valve in the port-closing position; said sleeve valve being movable to port-opening position and returned to port-closing position in response to the insertion and removal of a second flow control device in said receptacle bore; the improvement comprising said sleeve valve having latching recess means for coaction with latching means of a pulling tool, to enable withdrawal of said sleeve valve from said receptacle bore.

2. A well device as set forth in claim 1 said receptacle bore having an annular latching recess disposed below said lateral port means;

said sleeve valve having longitudinally extending collet fingers at its lower end, said collet fingers having outward projecting latching dogs at the distal ends thereof;

and said latching recess and said collet fingers defining said coacting latching means for retaining said sleeve valve in the port-closing position.

3. A well device as set forth in claim 2 a second flow control device comprising a control valve having an elongated body configured to be received in said receptacle bore; said control valve body having a reduced diameter prong configured to be received within said sleeve valve, and having an annular shoulder for engaging the upper end of said sleeve valve; said prong having a head at its distal end, and an adjacent reduced diameter neck configured to allow inward flexure of said sleeve valve collet fingers from the associated latching recess; and said sleeve valve being confined axially between said shoulder and said head when said collet fingers are flexed inwardly from the associated latching recess.

4. A well device as set forth in claim 3 said receptacle bore having a second annular latching recess disposed above said lateral port means; and said control valve body having radially movable latching lugs for engagement with said second latching recess; said latching lugs being engageable in said second latching recess to latch said control valve within said receptacle bore when said control valve has moved said sleeve valve to its valve-opening position.

5. A well device as set forth in claim 3 said control valve body having an internal longitudinal valve chamber disposed above said shoulder, having a larger bore portion at one end and a smaller bore portion at the other end providing an annular shoulder defining a valve seat; a valve closure member movable in said larger bore portion for coaction with said valve seat; a first lateral port means in the wall of said valve chamber opening from said smaller diameter portion, and a second lateral port means in the wall of said valve chamber opening from said larger diameter portion; said first lateral port means being disposed for lateral alignment with said receptacle bore lateral port neans, when said control valve is latched in said receptacle bore;

and said receptacle bore having a second lateral port means in the wall thereof opening to said mandrel main bore; said second receptacle bore port means being aligned laterally with said second lateral port means of said control valve, when said valve is latched in said receptacle bore.

6. A well device as set forth in claim 5 said control valve body having annular seal means disposed above said first named lateral port means, for coaction with said annular seal surface of said receptacle bore disposed above said first named lateral port means of said receptacle bore;

and said control valve prong having an annular seal means for coaction with an internal annular seal surface of said sleeve valve.

7. A well device as set forth in claim 5 said valve closure member comprising a valve having a cylindrical surface for sliding engagement with said larger bore portion of said valve chamber, and having spherical ends; and said valve seat being spherical for coaction with said valve closure member.

8. A well device as set forth in claim 5 said valve closure member comprising a modified sphere having cylindrical side walls.

9. A well device as set forth in claim 1 said second latching means of said sleeve valve comprising an internal annular latching recess;

a pulling tool for said sleeve valve comprising an elongated shaft having a coupling means at its upper end for enabling the lowering and raising of the tool; a tubular housing releasably attached to said shaft, having means providing a downward facing annular shoulder for engagement with the upper end of said sleeve valve, and having means for axially confining radially movable latching dogs; said dogs being maintained in lateral alignment with said sleeve valve latching recess when said housing shoulder is in engagement with said sleeve valve; and said shaft having cam means for moving said dogs outward into said latching recess when said shaft is moved downwardly relative to said tubular housing; and said shaft having expansible latching means adjacent to its lower end for engaging an end face of said tubular housing, whereby the raising of said shaft will raise said tubular housing.

10. A well device as set forth in claim 9 said pulling tool having a first releasable means securing said tubular housing to said shaft; said first releasable means being released by relative downward movement of said shaft to engage said latching dogs and to engage said expansible latching means with said end face of said housing; said shaft having a second releasable means for retaining axially said expansible latching means; said second releasing means releasing in response to upward movement of said shaft relative to said tubular housing to allow disengagement of said latching dogs from said sleeve valve latching recess.

11. A well device as set forth in claim 9 said expansible latching means comprising a snap ring.

12. A well device as set forth in claim 9 said pulling tool having a first shear pin securing said tubular housing to said shaft; said first shear pin being severed by relative downward movement of said shaft to engage said latching dogs in said latching recess and to effect engagement of said lower expansible latching means with said end face of said housing; said shaft having a second shear pin for retaining axially said expansible latching means; said second shear pin being severed in response to upward movement of said shaft relative to said tubular housing to allow disengagement of said latching dogs from said sleeve valve latching recess.

13. In a well device for controlling flow between the exterior and interior of a well flow conductor which includes: a side pocket mandrel having a longitudinal main bore and having a longitudinal receptacle bore in said side pocket opening to said main bore, said mandrel being connectible in said well flow conductor with its main bore in axial alignment therewith; said receptacle bore having lateral port means through the wall thereof to the exterior of said mandrel, and annular seal surface means at opposite sides of said lateral port means engageable with a flow control device; a first flow control device comprising a sleeve valve disposed for reciprocation in said receptacle bore between port-closing and port-opening positions for controlling flow through said lateral port means, said sleeve valve having seal means coacting with said annular seal surface means of said receptacle bore; said receptacle bore and said sleeve valve having coacting latching means for retaining said sleeve valve in the port-closing position; said sleeve valve being movable to port-opening position and returned to port-closing position in response to the insertion and removal of a second flow control device in said receptacle bore; a second flow control device comprising a control valve having an elongated body configured to be received within said receptacle bore; said sleeve valve and said control valve having coacting latching means for coupling said sleeve valve to said control valve; the improvement comprising said control valve body having an internal longitudinal valve chamber, including a larger bore portion at one end and a smaller bore portion at the other end providing an annular shoulder defining a valve seat; a valve closure member movable in said larger bore portion for coaction with said valve seat; a first lateral port means in the wall of said valve chamber opening from said smaller diameter portion, and a second lateral port means through the wall of said chamber opening from said larger diameter portion; said first lateral port means being disposed for lateral alignment with said receptacle bore lateral port means, when said control valve is latched in said receptacle bore;

and said receptacle bore having a second lateral port means in the wall thereof opening to said mandrel main bore; said second control valve port means being aligned laterally with said second receptacle bore port means, when said control valve is latched in said receptacle bore.

14. A well device as set forth in claim 13 said control valve body having an annular seal means disposed above its first lateral port means, for coaction with said annular seal surface of said receptacle bore disposed above its first lateral port means; and said control valve and said sleeve valve having coacting seal means acting therebetween.

15. A well device as set forth in claim 13 said valve closure member having a cylindrical surface for sliding engagement with said larger bore portion of said valve chamber, and having spherical ends; and said valve seat having a coacting spherical seating surface.

16. A well device as set forth in claim 13 said valve closure member being movable, in the open position of said control valve, completely out of the flow path of fluid through said valve.

17. A pulling tool for withdrawing a tubular member from a flow conductor, wherein said tubular member has an internal annular latching recess, said tool comprising an elongated shaft having a coupling means at its upper end for enabling the lowering and raising of the pulling tool; a tubular housing releasably mounted on said shaft for relative axial movement, having means at its upper end providing an external downward facing shoulder for engagement with the upper end of said tubular member, and having means for axially confining radially movable latching dogs; releasable coupling means securing said housing to said shaft; latching dogs disposed in said tubular housing in lateral alignment with the latching recess of said tubular member, when said housing shoulder is in engagement with said tubular member;

said shaft having recess means for receiving said dogs, and having associated cam means for moving said dogs radially outward into said latching recess when said shaft is moved downward relative to said tubular housing;

and said shaft having radially expansible latch means for engaging an end face of said tubular housing, when said shaft is moved downward relative to said tubular housing, whereby the subsequent raising of said shaft will raise said tubular housing.

18. A pulling tool as set forth in claim 17 said pulling tool having first shear means releasably coupling said tubular housing to said shaft; said first shear means being severed by relative downward movement of said shaft to expand said latching dogs and to engage said expansible means with said end face of said housing; said shaft having second shear means releasably coupling axially said expansible means thereto; said second shear means being severed in response to a binding condition of said tubular member, to enable said shaft to move upwardly relative to said housing and said tubular member to allow disengagement of said latching dogs from said tubular member latching recess.

19. A pulling tool as set forth in claim 17 a retaining member releasably mounted on said shaft at its distal end, for retaining axially said expansible latch means; releasable coupling means securing said retaining member to said shaft; said shaft being releasable from said retaining member to permit upward movement of said shaft relative to said tubular housing to again align laterally said shaft recess means with said dogs.

20. A pulling tool as set forth in claim 19 said retaining member being additionally coupled to said shaft for limited relative longitudinal movement by a limited motion coupling means; said limited motion coupling means effecting the alignment of said shaft recess means and said dogs, when said releasable coupling means for said retaining member releases.

* * * * *